US006627055B2

(12) United States Patent
Bishop et al.

(10) Patent No.: US 6,627,055 B2
(45) Date of Patent: Sep. 30, 2003

(54) MANUFACTURE OF FINE-GRAINED ELECTROPLATING ANODES

(75) Inventors: William J. Bishop, Amherst, OH (US); David Krus, Jr., University Heights, OH (US)

(73) Assignee: Brush Wellman, Inc., Cleveland, OH (US)

( * ) Notice: Subject to any disclaimer, the term of this patent is extended or adjusted under 35 U.S.C. 154(b) by 165 days.

(21) Appl. No.: 09/897,842

(22) Filed: Jul. 2, 2001

(65) Prior Publication Data

US 2003/0000604 A1 Jan. 2, 2003

(51) Int. Cl.[7] ..... C25B 11/04

(52) U.S. Cl. ..... 204/293; 204/280; 204/292; 164/459; 164/476; 164/122; 148/529; 148/553; 148/554; 148/679; 148/680; 148/681; 148/684; 29/526.3; 29/526.4; 29/527.5; 29/527.7

(58) Field of Search ..... 164/459, 467, 164/476, 478, 484, 488, 499, 71.1, 122; 148/512, 538, 553, 554, 558, 679, 680, 681, 684; 29/526.3, 526.4, 527.5, 527.6, 527.7; 204/293, 292, 280

(56) References Cited

U.S. PATENT DOCUMENTS

| | | | | | |
|---|---|---|---|---|---|
| 4,315,538 | A | * | 2/1982 | Nielsen | 164/488 |
| 4,789,648 | A | | 12/1988 | Chow et al. | |
| 5,279,353 | A | | 1/1994 | Nielsen, Sr. et al. | |
| 5,539,255 | A | | 7/1996 | Cronin | |
| 6,500,284 | B1 | * | 12/2002 | Zhou et al. | 148/551 |

* cited by examiner

*Primary Examiner*—Bruce F. Bell
(74) *Attorney, Agent, or Firm*—Calfee, Halter & Griswold, LLP

(57) ABSTRACT

A continuously cast copper ingot is made by a procedure in which turbulence is imparted to the metal/solid interface during the casting operation. The ingot is then hot worked to form a billet having a smaller average grain size and a larger diameter than possible in the past. The billet is especially useful for making electroplating anodes used in the damascene process for making copper interconnects in silicon wafers.

26 Claims, No Drawings

MANUFACTURE OF FINE-GRAINED ELECTROPLATING ANODES

FIELD OF THE INVENTION

The present invention relates to making fine-grained electroplating anodes especially useful for producing copper interconnects in silicon semiconductor chips.

BACKGROUND

Copper interconnects in multi-layer silicon wafers and semiconductor chips are often made by the damascene process. This process is described in U.S. Pat. No. 4,789,648 and U.S. Pat. No. 5,539,255, the disclosures of which are incorporated herein by reference.

In this process, copper is selectively electrodeposited onto a silicon wafer from an electroplating anode made from copper or copper alloy. Before electrodeposition, an intricate circuit pattern of trenches is etched into the wafer to define the interconnects to be formed. The anode is then mounted in close proximity to, but not touching, the wafer. Both are immersed in an electrolytic bath, where copper from the anode is electrodeposited onto the wafer.

Typical electroplating anodes for use in the damascene process take the form of squat, cylindrical copper discs 200 to 300 mm in diameter and 2 to 6 cm thick. In some instances, the anode is formed with a hollow interior so that it is annular in configuration rather than cylindrical. In either case, the surface of the anode is machined very flat to provide uniform deposition over the entire silicon wafer. Uniform deposition is critical because the wafer will be sectioned to make several chips and each chip is intended to be identical to the next.

Electroplating anodes for the damascene process are produced commercially by sectioning copper rods and tubes and then machining the sections to the desired flatness on one face and to a mounting configuration on the other opposite face. The mounting configuration is dependent on the particular electrodeposition system in which the anode is used. These copper rods and tubes, in turn, are typically made by a multi-step step process including casting, hot working, cold working and annealing.

In order to achieve optimal performance in the damascene process, the average size of the copper grains in these anodes, and hence the rods and tubes used to make these anodes, should be no more than about 150 $\mu$m. In addition, the grain size distribution should be fairly uniform throughout the cross section of the rod or tube and anode. A fine, uniform grain structure is important in maintaining smoothness (or, more accurately, "local flatness") of the anode face. Moreover, a finer grain structure may be machined and polished to a smoother initial surface finish and, during deposition, the anodes will erode more uniformly and stay smooth for a longer time. A rough anode face is deleterious to uniform copper deposition.

Unfortunately, conventional manufacturing processes can only produce average grain sizes as small as 200 $\mu$m in rods and tubes with diameters of 200 mm or more. Average grain size is often much larger. Moreover, grain size distributions in such rods and tubes are not particularly uniform. Furthermore, conventional billet manufacturing processes are inherently expensive, since they require multiple working steps including at least one cold working step.

In this connection, there are basically two different ways as a practical matter for reducing grain size of copper rods and tubes produced by conventional continuous casting procedures. The first is to hot work several times including reheating the billet between the hot working steps. The second, which is the technique normally used commercially, is to hot work and then cold work the billet followed by annealing. Both require a substantial amount of mechanical working—on the order of 10 to 1 or more in terms of reduction in cross sectional area. Accordingly, these techniques can be very expensive. Furthermore, above a section thickness of about three inches or more, conventional cold working equipment cannot accomplish grain size reduction uniformly. In addition, cracks and other imperfections often occur during cold working leading to the production of large amounts of scrap and/or unacceptable product. As a practical matter, therefore, conventional manufacturing processes cannot consistently and reliably achieve average grain sizes as small as 200 $\mu$m in copper rods and tubes with diameters of 200 mm or more.

Accordingly, there is a need for a new manufacturing process which can consistently and reliably produce copper rods and tubes having average grains sizes significantly less than 200 $\mu$m, typically about 150 $\mu$m or less, in rods and tubes with diameters of 200 to 300 mm or even more. In addition, it would also be desirable if such a process could provide rods and tubes with fairly uniform grain size distributions. And, it would be especially desirable if such a process could be done using less working steps than required in conventional processes, so that manufacturing costs could be reduced.

SUMMARY OF THE INVENTION

In accordance with the present invention, it has been found that copper ingots can be directly formed into rods and tubes having diameters of 200 mm or more and average grain sizes of 150 $\mu$m and less by simple hot working, provided that the ingots are made by a continuous casting procedure in which turbulence is imparted to the metal/solid interface during the casting operation.

Accordingly, the present invention provides a new process for producing a copper or copper alloy billet comprising forming an ingot by a continuous casting procedure in which turbulence is imparted to the metal/solid interface in the casting die and thereafter hot working the ingot so formed to produce the billet.

In addition, the present invention also provides a new copper or copper alloy billet which is made by this process and which has a diameter of at least about 200 mm and an average grain size of about 180 $\mu$m or less, preferably 150 $\mu$m or less.

Similarly, the present invention also provides new electroplating anodes made from such rods and tubes.

DETAILED DESCRIPTION

In accordance with the present invention, copper and copper alloy rods and tubes having diameters of at least 200 mm and average grain sizes of 150 $\mu$m or less are made by hot working ingots formed by a continuous casting procedure in which turbulence is imparted to the metal/solid interface during the casting operation.

Composition

The same coppers and copper alloys used to make conventional electroplating anodes for the damascene process and other plating processes can be used to make the rods and tubes and anodes of the present invention. Examples of such coppers and copper alloys are the deoxidized high phosphorous alloys (C12200, C12210 and C12220), the phosphorous deoxidized tellurium-bearing alloys (C14500, C14510 and C14520) and the phosphorous deoxidized sulfur-bearing alloys (C14700, C14710 and C14729).

In general, any copper or copper alloy can be used which does not contain ingredients, or amounts of ingredients, imparting an adverse impact on the silicon wafers and chips produced by the anodes of the present invention. The copper or copper alloy should also be compatible with the equipment used in the continuous casting process in the sense that no adverse interaction occurs between the two. For example, if a graphite mold is used, coppers or copper alloys which stick to graphite should be avoided.

Turbocasting

Conventional continuous casting is a well known technology in which molten metal flows through a vertically-arranged mold whose inlet is continuously fed with molten metal while frozen, solid metal is being withdrawn from the mold bottom. A cooler is provided to cool the mold and, thus, the metal passing through the mold. Pinch rollers or other withdrawal mechanisms are provided for controlling the rate at which the solidified billet passes out of the die while maintaining the liquid/solid interface of the metal being cast within the confines of the mold.

When copper and copper alloys are continuously cast following this general procedure, gross directional solidification occurs during transition of the metal from liquid to solid. This results in large, coarse, elongated crystals composed of dendrites being formed during solidification. This gross crystal structure imparts poor mechanical properties to the product ingot, and so it is customary to work the ingot to break up these large crystals and dendrites to a much smaller size.

To overcome this problem, U.S. Pat. No. 4,315,538 and U.S. Pat. No. 5,279,353, the disclosures of which are incorporated herein by reference, describe a modified continuous casting process in which turbulence is imparted to the molten metal immediately above the liquid/solid interface in the casting mold (hereinafter "turbocasting"). This can be done, for example, by feeding the molten metal into the casting mold through slots in a die cap or the side walls of the die, the slots being arranged to impart a cyclonic motion to the molten metal in the die. Alternatively, mechanical or magnetic mixers can be used to impart this turbulence. In addition, any other technique which will achieve the same turbulence in a continuous casting die can be used.

Imparting turbulence to the molten metal in this way leads to greater uniformity in cooling than in conventional practice. In addition, it also leads to a shearing by high velocity molten metal of the primary dendrites which otherwise would form adjacent to the side wall of the die upon solidification. The net result is that a much better crystal structure is obtained in which the crystals are essentially equiaxed in configuration, finer in size, and distributed "more uniformly" than in ingots made by conventional practice. Because of this improved grain structure, the rods and tubes so obtained are amenable to hot and cold working, thereby eliminating production of large amounts of scrap and unacceptable product.

In accordance with the present invention, it has been found that continuously cast copper and copper alloy ingots made by turbocasting can be directly formed into large diameter rods and tubes having grain sizes of about 150 $\mu$m or less by simple hot working to a reduction of cross sectional area of 6 to 1 or less. In particular, it has been found that the grain structure of copper ingots produced by turbocasting is fine enough and uniform enough so that simple hot working to a reduction of cross sectional area of 6 to 1 or less will achieve grain sizes of about 150 $\mu$m and less, even in product rods and tubes having diameters of 200 to 300 mm or more. Accordingly, it is possible in accordance with the present invention to reduce the number of working steps (and the total amount of working) done on large diameter rods and tubes in traditional grain refinement processes while still achieving the smaller grain sizes accomplished by these processes.

Indeed, it has been found that the present invention will achieve average grain sizes significantly less than the 200 $\mu$m minimum possible in conventional practice, thereby making it possible to produce products previously unavailable on an industrial scale. Thus, copper and copper alloy rods and tubes greater than 200 mm, greater than 250 mm and even greater than 300 mm, in diameter and further having average grain sizes of 175 $\mu$m or less, more desirably 150 $\mu$m or less, and even 100 $\mu$m or less can be reliably and consistently produced by the present invention on an industrial scale, which is not possible with conventional technology.

Hot Working

As well understood, "working" refers to the significant, uniform mechanical deformation traditionally done to a metal or alloy to achieve a finer, more nearly-uniform grain structure. Working can either be done while the metal is above its solidus temperature, which is referred to as "hot working," or below its solidus temperature, which is referred to as "cold working."Normally, hot working is done at temperatures above the midpoint of the range between 0° C. and the melting or solidus temperature of the alloy, while cold working is normally done at or near room temperature. Since most metals are considerably softer at elevated temperatures, hot working can be performed over a larger range of cross-sections than cold working since less force is required.

Hot working can be done in accordance with the present invention using any technique which will accomplish the necessary uniform mechanical deformation. For example, forging or rolling can be employed. Normally however extrusion will be used, since the turbocast ingots to be deformed have a uniform or constant cross-sectional shape along their lengths.

Also, hot working in accordance with the present invention can be done in a single step or in multiple steps with or without intermediate heat treatments, as desired. In this connection, a significant feature of the present invention, as indicated above, is that significantly less working is required than in prior technology. In prior technology, area reductions of at least 10 to 1 are necessary to achieve the desired grain structure. Such large area reductions can only be accomplished with multiple working steps, either multiple hot working steps or hot working followed by cold working and subsequent anneal. In accordance with the present invention, however, desired grain structures can be achieved with much less working, e.g. area reductions of 6 to 1 or less, because turbocast billets are used. Such limited amounts of working can be achieved by a single hot working step, if desired, which is easier and less expensive to carry out. Furthermore, such limited amounts of working also translate to reduced production of waste due to ingot cracking and other similar phenomena. Multiple hot working steps and/or hot working followed by cold working can, of course, also be used if desired. However, even in this case the inventive technology is easier and less expensive to carry out because the overall amount of working needed to achieve the desired grain structure is considerably less.

The temperature at which hot working is done in accordance with the present invention is not critical. Normally, however, hot working will be done within 200° F. of the solidus temperature of the particular metal being processed, since metal deformation is easier at these higher temperatures. In general, this means that hot working will normally be done at about 900° F. to 1800° F., more typically about 1000° F. to 1300° F. or even 1100° F. to 1200° F. Also, hot working can be done immediately after turbocasting, i.e. without cooling to cold working temperatures first, or alternatively after the ingot has been cooled to lower temperatures such as ambient temperature and then reheated to hot working conditions.

The amount of hot working done in carrying out the present invention should be sufficient to achieve the average grain size desired in the billet being produced. Normally, this means that hot working will be done by an amount of about 4 to 1 to about 6 to 1 in terms of area reduction, although amounts as little as 3.5 to 1 or even 3 to 1 are contemplated. Hot working by about 5 to 1 in terms of area reduction is typical. Hot working by amounts greater than about 6 to 1 are not normally necessary to achieve the desirable results of the present invention, although such large amounts of hot working may be advisable in limited instances.

In this connection, the amount of hot working needed to achieve the desirably small average grain sizes of the present invention varies considerably from case to case and depends on a variety of factors including the fineness of the cast microstructure, product diameter and composition of the ingot being processed as well as the manner in which hot working is carried out. With the above as a guide, however, the particular hot working conditions to be used in carrying out particular embodiments of the present invention can be easily determined by routine experimentation.

Billet Size

An important feature of the present invention is that finished products with large cross-sections can be produced. This is possible at least in part because much less working in terms of total area reduction is necessary to achieved the desired grain size relative to conventional technology. Thus, the present invention can eliminate the cold working step or subsequent hot working step of conventional technology, if desired. In any event because less area reduction is required in the inventive technology compared with conventional technology, less reduction in billet size is also achieved as a result of the working operation. The net effect is that product rods and tubes with larger diameters can be achieved by the present as compared with conventional practice when both start with ingots of the same size.

Thus, the present invention can easily provide cylindrical rods and tubes having diameters 200 to 350 mm, for example, by starting with turbocast ingots of 17 to 30 inches (about 430 to 760 mm), for example. Rods and tubes of this size, with the desired fine average grain structure, become very difficult if not impossible to produce by conventional technology, because the amount of working required dictates a starting ingot which is too big as a practical matter.

A further advantage of the present invention is that the product billets exhibit a greater degree of uniformity in grain structure from ingot center to surface than possible with prior technology. Significant non-uniformity in grain size distribution from ingot center to surface and gross ingredient segregation are the normal result when coppers and copper alloys are made using conventional continuous casting technology. This problem is only exacerbated when ingot diameters become large. This problem is largely eliminated by the present invention because the as-cast ingot produced by turbocasting already exhibits an improved grain size and grain size distribution.

Anode Manufacture

Electroplating anodes are made from the product rods and tubes of the present invention in the same way as conventional anodes. Thus, the hot worked rods and tubes are typically subdivided into sections normally about 10 to 50 times longer than the rods or tubes are thick, typically about 2 to 6 cm thick, and then machined to impart the desired flatness and mounting features. This produces anodes typically in the form of cylindrical discs 200 to 300 mm in diameter and, with a major face of the discs having a desired flat surface. Discs of different and even larger diameters and thickness can be produced. For example, discs with diameters of 250 mm or larger, 300 mm or larger, 325 mm or larger and even 350 mm or larger are contemplated, as are discs with thickness of 2.5 to 5 cm, 2 to 6 cm or even 1 to 10 cm. Indeed, the only constraint on the length of the tubes is the length of the rod or tube produced by hot working the turbocast billet.

Although similar in size and shape to conventional anodes, the anodes of the present invention differ from those produced by conventional technology in that they typically have average grain sizes of 175 $\mu$m or less, 150 $\mu$m or less, and even 100 $\mu$m or less. This represents a significant advance over conventional anodes which have larger average grain sizes, as indicated above.

Other Billet Configurations

Although the invention has been described above in terms of producing rods and tubes and anodes with a cylindrical configuration, other product configurations are also contemplated. Thus, the present invention can be used to produce anodes and rods and tubes which have noncircular cross-sectional shapes such as squares, ovals, polygons, star patterns, and the like. These products can also be made to have the same minimum thickness dimensions (8 to 14 inches or more) and the same average grain sizes ($\leqq$175 $\mu$m, $\leqq$150 $\mu$m or even $\leqq$100 $\mu$m) as the cylindrical products discussed above by following the present invention. Similarly, annular rods and tubes and anodes having outside diameters of about 8 to 14 inches (about 200 to 360 mm), inside diameters of about 5 to 9.5 inches (about 13 to 24 mm) and wall thicknesses on the order of about 1 to 3 inches (about 2.5 to 8 mm), more typically about 1.5 to 2.5 inches (about 4 to 6.5 mm) and even more specifically about 2 inches (about 5 mm), can be easily made in accordance with the present invention.

Optional Hot Working and Cold Working Steps

A desirable feature of the present invention is that the inventive rods and tubes can be produced without cold working, and without multiple hot working steps, as this reduces the overall cost of billet manufacture. On the other hand, the rods and tubes produced by the present invention can be subjected to cold working, before or after hot working, or multiple hot working steps, if desired. A significant advantage of the invention is that large diameter rods and tubes can be produced with smaller average grain sizes than possible before. This advantage will still be realized even if the billet is cold worked or subjected to multiple hot working steps in accordance with conventional technology.

WORKING EXAMPLES

In order to describe the present invention more thoroughly, the following working examples are provided.

Example 1

A cylindrical ingot 17 inches in diameter and made from Alloy C12220 (Cu 99.9% minimum, P 0.040 to 0.065%) was produced by the turbocasting procedure described above and in the above-noted U.S. Pat. No. 4,315,538 and U.S. Pat. No. 5,279,353.

After cooling to ambient, the billet so formed was heated to 1100° F. and forward extruded to 8.25 inches (21 cm) in diameter. The hot worked billet was then sawed into anode blanks 1⅜ inches (3.5 cm) long, and the average grain size of the billets determined in accordance with ASTM E-112. It was determined that the average grain size of the anode blanks so produced was 54 μm to 150 μm.

Example 2

Example 1 was repeated except that a 5.0 inch (12.7 cm) hole was drilled through the center of the billet and the billet was then extruded to form a tube having an outside diameter of 9.5 inches (24.1 cm) and an inside diameter of 4.8 inches (12.2 cm). In addition, the tube was subdivided into anode blanks 2.5 inches (6.4 cm) long. The average grain size of the anode blanks so produced was 15 μm to 90 μm.

Although only a few embodiments of the present invention have been describe above, it should be appreciated that many modifications can be made without departing from the spirit and scope of the invention. All such modifications are intended to be included within the scope of the present invention, which is to be limited only by the following claims:

We claim:

1. A process for producing a billet useful for making an electroplating anode comprising forming a copper or copper alloy ingot by turbocasting, and hot working the ingot so formed to form the billet.

2. The process of claim 1, wherein the billet is made without cold working.

3. The process of claim 2, wherein the ingot is hot worked by at least 3 to 1 but no more than about 6 to 1 in terms of area reduction.

4. The process of claim 3, wherein the billet has a diameter of at least about 200 mm and an average grain size of about 175 μm or less.

5. The process of claim 4, wherein the billet has a diameter of at least about 250 mm and an average grain size of about 150 μm or less.

6. The process of claim 3, wherein the billet has a diameter of at least about 200 mm and an average grain size of about 100 μm or less.

7. The process of claim 1, wherein the ingot is made by a procedure in which liquid alloy is continuously cast through a die, liquid metal being introduced into the interface zone between the liquid and solid metal in a manner imparting motion to the metal in this interface zone sufficient to shear the primary dendrites adjacent the side wall of the die whereby the ingot produced exhibits a fine equiaxed grain structure and an essentially uniform grain size distribution.

8. A copper or copper alloy billet useful for making an electroplating anode, the billet having a diameter of at least about 200 mm and an average grain size of about 175 μm or less.

9. The billet of claim 8, wherein the billet has a diameter of at least about 250 mm and an average grain size of about 150 μm or less.

10. The billet of claim 8, wherein the billet has a diameter of at least about 200 mm and an avenge grain size of about 100 μm or less.

11. The billet of claim 8, wherein the billet is made by hot working an ingot formed by turbocasting.

12. The billet of claim 11, wherein the billet is made without cold working.

13. An anode for mounting in an electrodeposition system for carrying out the damascene process comprising a shaped article formed from copper or a copper alloy, the shaped article being 2 to 6 inches thick and defining a major face having a minimum transverse dimension of about 200 mm, the major face being machined flat for receiving a semiconductor wafer, the shaped article defining an opposite face opposite the major face for mounting the anode in the electrodeposition system, the copper or copper alloy forming the anode having an average grain size of about 175 μm or less.

14. The anode of claim 13, wherein the average grain size is about 150 μm or less.

15. The anode of claim 13, wherein the average grain size is about 100 μm or less.

16. The anode of claim 13, wherein the anode is formed from a billet formed by hot working a turbocast copper or copper alloy ingot.

17. The billet of claim 16, wherein the billet is made without cold working.

18. A process for producing a billet useful for making an electroplating anode, the billet having a diameter of at least about 200 mm and an average grain size of about 175 μm or less, the process comprising forming a copper or copper alloy ingot by turbocasting, and hot working the ingot so fanned by at least 3 to 1 but no more than about 6 to 2 in terms of area reduction to thereby form the billet without cold working.

19. A process comprising hot working a copper or copper alloy ingot formed by turbocasting to form a billet having a diameter of at least about 200 mm and an average grain size of about 175 μm or less.

20. The process of claim 19, wherein the ingot is hot worked by at least about 3 to 1 but no more than about 6 to 1 in terms of area reduction.

21. The process of claim 20, wherein the billet has a diameter of at least about 250 mm and an average grain size of about 150 μm or less.

22. The process of claim 21, wherein the billet has a diameter of at least about 200 mm and an average grain size of about 100 μm or less.

23. The process of claim 20, wherein the ingot is cooled to ambient before hot working.

24. The process of claim 23, wherein the billet is formed without cold working.

25. The process of claim 23, wherein the billet is formed without cold working.

26. The process of claim 19, wherein the ingot is cooled to ambient before hot working.

* * * * *